United States Patent [19]

Esparza

[11] Patent Number: 4,694,841

[45] Date of Patent: Sep. 22, 1987

[54] SYSTEM FOR THE SELF-LIGHTING OF CIGARETTES

[76] Inventor: Natividad G. Esparza, C/ Bolivia 15, 28016-Madrid, Spain

[21] Appl. No.: 747,562

[22] Filed: Jun. 21, 1985

[30] Foreign Application Priority Data

Jul. 17, 1984 [ES] Spain ..... 534.390
Jan. 11, 1985 [ES] Spain ..... 539.495

[51] Int. Cl.[4] ..... A24D 1/08
[52] U.S. Cl. ..... 131/351; 131/88
[58] Field of Search ..... 131/351, 88

[56] References Cited

U.S. PATENT DOCUMENTS 2,370,306 2/1945 Haber ..... 131/351
3,109,435 11/1963 Paley ..... 131/351
4,178,945 12/1979 De Capitani .
4,310,007 1/1982 Auersbach .

*Primary Examiner*—V. Millin
*Attorney, Agent, or Firm*—Ostrolenk, Faber, Gerb & Soffen

[57] ABSTRACT

A system for self-lighting cigarettes includes a cigarette and a cap coupled to the front end of cigarette. The cap includes a housing coupled to one end of the cigarette and having a hollow chamber formed therein. In a first embodiment, first and second containers are located in the chamber and contain respective substances which react with each other when released from their respective containers to produce a sufficient amount of heat to ignite the front end of the cigarette. In a second embodiment, a single container is located in the chamber and contains a substance which reacts, upon direct contact with air, to produce a sufficient amount of heat to ignite the front end of the cigarettes. The cigarette is ignited by carrying out a predetermined actuation which breaks the containers.

28 Claims, 9 Drawing Figures

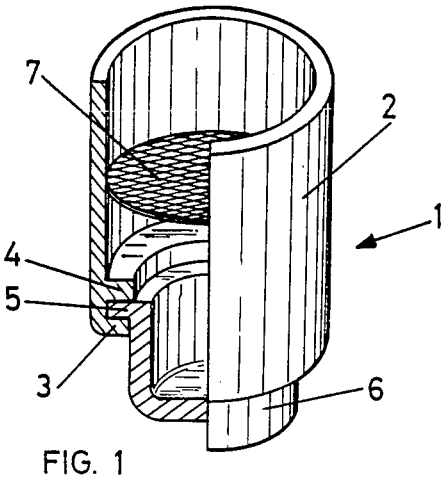
FIG. 1
FIG. 2
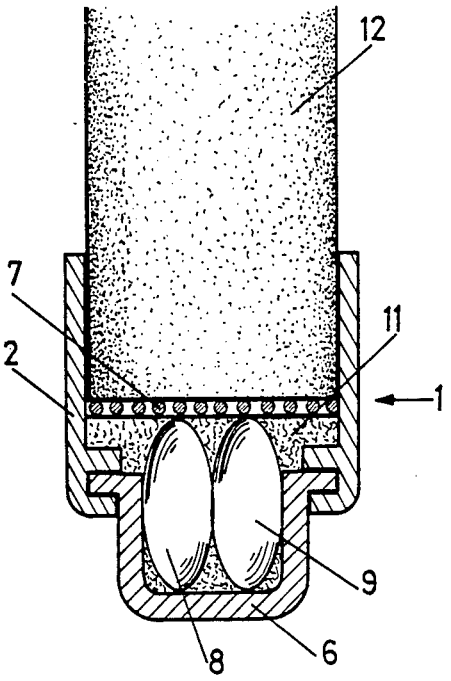
FIG. 3
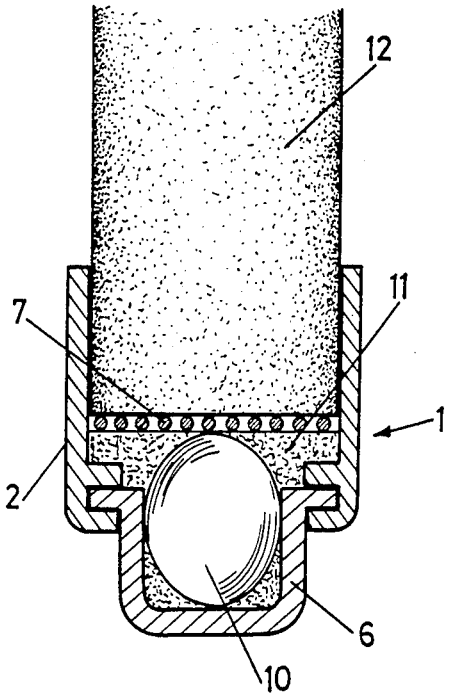

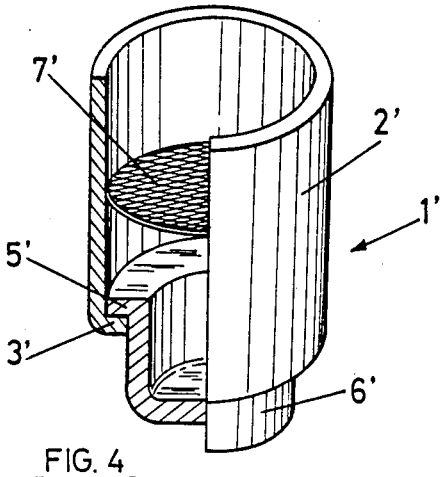
FIG. 4
FIG. 5
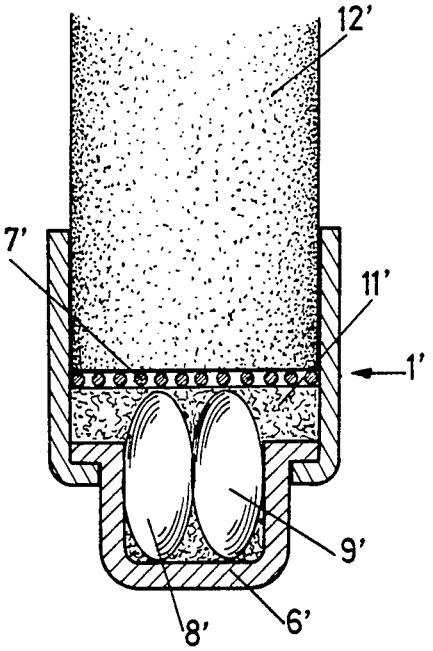
FIG. 6
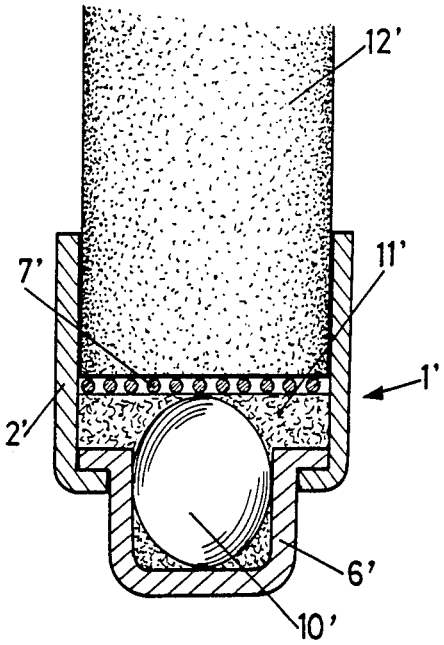

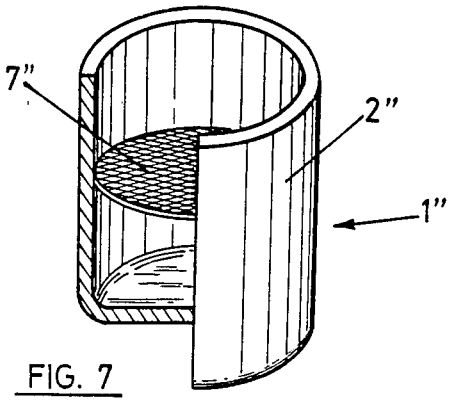
FIG. 7
FIG. 8
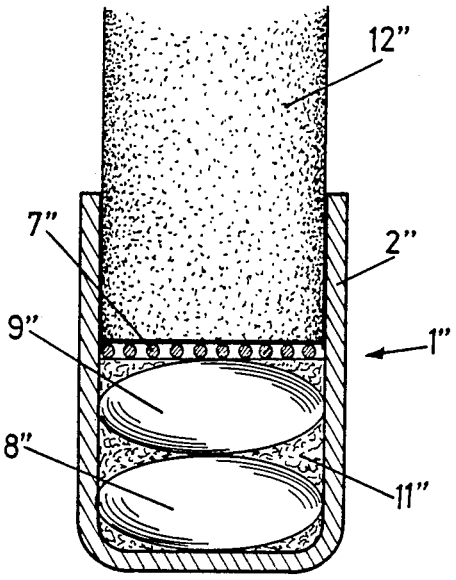
FIG. 9
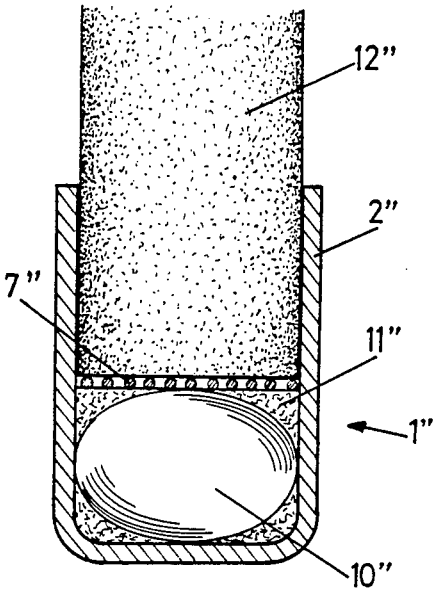

SYSTEM FOR THE SELF-LIGHTING OF CIGARETTES

BRIEF SUMMARY OF THE INVENTION

The purpose of this invention is to provide a self-igniting system for cigarettes.

The invention is basically comprised of a disposable cap, located on the tip of the cigarette, which contains at least one organic and/or inorganic element or combinations of elements, between the base of the cap and a grid. In this way, the elements can be preserved and protected in the most optimal and stable conditions. Moreover, these are elements which may react to generate the heat necessary to light the cigarette and can be brought into contact via a series of means.

The invention could also come equipped with at least one coadjutant that would act as a moderator to the duration and temperature of the reaction.

The reactive elements may be isolated, thereby assuring their preservation and stability.

The new system envisaged in this invention provides the following advantages:

(a) The cap protects the cigarette tip.

(b) It eliminates the need to constantly carry around the cigarette pack, plus a lighter or match, since the system is self-igniting.

(c) It guarantees that the cigarette can be lit under any weather condition, since ignition takes place within a protective covering.

(d) The smoker does not inhale toxic or unpleasant tasting gases.

Although a great range of exothermic reactions can produce the heat necessary to ignite the tobacco as foreseen in the invention design, alkaline and pyrophoric metals have been selected as one in a series of possible solutions. These metals enable the reaction to take place at ambient temperature. Although all the elements in these groups can produce the effect necessary for self-ignition of the cigarette as proposed in the new system, the following two examples have been chosen in particular:

$$2Na + 2H_2O \rightarrow 2Na(OH) + H_2 + \text{heat} \quad (1)$$

$$\text{Raney Ni} + \text{air} \rightarrow Ni_2O_3 + \text{heat} \quad (2)$$

The heat produced in both of the above cases is sufficient to ignite the tobacco. Furthermore, many other organic or inorganic elements or combinations of the same which react and propagate at higher temperatures can also be used. Among the latter, nitrocellulose or potassium chlorate, coupled with a suitable fuel source, such as tobacco or glucose are possible choices. If this were the case, alkaline or pyrophoric metals or the like would simply initiate reaction. This combination of reactants can optimize the self-igniting effect in terms of time, cost, the amount of reactants used and the ultimate heat generated.

In order to ensure the most appropriate conditions for the reaction, the reactants should preferably be isolated to preserve and stabilize them.

A moderator is recommended, and could be tobacco fiber, calcium carbonate and/or activated carbon and/or charcoal, as well as solvents such as alcohol or ketone, or a peroxide, among a long list of others.

In the case of reaction (1), calcium carbonate would be used as indicated above, to delay the process.

Charcoal and/or activated carbon provide identical results in reaction (1) to those produced by an organic plant fiber, except for the amount of carbon available for reaction. The percentage of carbon in a plant fiber such as tobacco usually does not exceed 30%. Therefore, charcoal and activated carbon, among others, work as coadjutants to the reaction by moderating the latter and acting as a filter for combustion.

When calcium carbonate and charcoal and/or activated carbon are used simultaneously, the result is a combination of the aforementioned cases, i.e., they will moderate the reaction and optimize performance and propagation.

If alkaline metals are employed, the metal must be accompanied by water and preferably by other moderators. One possible moderator would be ethyl alcohol, which moderates the reaction due to the presence of hydroxyl groups. The same effect can be obtained with peroxides, such as $H_2O_2$, among others, which rapidly oxidize alkaline metal and prevent it from breaking down abruptly in the water.

As far as reaction (2) is concerned, if a solvent is brought into contact with the Raney nickel, reaction time can be controlled by delaying contact with the oxygen in the surrounding air.

The cap contains the reactants and detaches from the cigarette once ignition is complete. Cap shape will depend on the ignition system in question and will vary accordingly. Of all the possible ignition systems, the following solutions have been chosen as practical examples:

(a) Twisting one part of the cap around a part fixed to the tip of the cigarette.

(b) Applying axial pressure to the cap to slide one part of the cap along the other.

(c) Applying radial pressure to cave in the side walls of the cap.

In these cases the container(s) for the reactants will be located between the base of the cap and a grid which will butt against the cigarette tip on one end, and on the other, against said container(s), preventing debris, ash, etc. caused by ignition from coming into contact with the cigarette.

If alkaline metals are used in conjunction with moderators such as calcium carbonate and/or activated carbon and/or charcoal, the moderators can be mixed with tobacco and located in the space remaining in the cap around the container(s). If liquid moderators, such as the previously mentioned solvents or peroxides are employed, these will be mixed with water as reactants.

Pyrophoric metals, given their special ignition features, can utilize moderators such as the aforementioned ones (except for peroxides), as well as tobacco fiber alone, or other organic or inorganic components such as alcohol or water.

In both cases, propagators such as the ones described earlier, which react at higher temperatures, can be placed around the containers.

In order to better understand this invention, a detailed description follows to illustrate without delimiting the design.

BRIEF DESCRIPTION OF THE DRAWINGS

This is explained in a series of drawings in which:

FIG. 1 represents a view of the twist activated cap, as designed for this invention. A cutaway is provided in order to view the inside of the cap.

FIGS. 2 and 3 show the assembly of the cap found in FIG. 1 to the cigarette. Two containers can be seen in FIG. 2 and will contain sodium and water, if applicable. In FIG. 3 the single container for Raney nickel can be observed for cases using this solution.

FIG. 4 is similar to FIG. 1, with the exception that it is an axial ignition system.

FIGS. 5 and 6 illustrate two applications which are similar to FIGS. 2 and 3, however, in this case the cap is activated by axial pressure, as seen in FIG. 4.

FIG. 7 gives a view much like that in FIGS. 1 and 4, but with a radial ignition system.

FIGS. 8 and 9 show a radially activated cap in two cases similar to those in FIGS. 2 and 3 or 5 and 6.

DETAILED DESCRIPTION OF THE INVENTION

In FIGS. 1 to 3, it can be observed that the cap 1 includes a cylindrical body body 2 and a closed cylindrical base 6. A plurality of air holes (not shown in the drawing), are formed in both the body 2 and the base 6 and are designed to facilitate the flow of air into the cap. Two ribs 3, 4 circle the end of the cylindrical body 2, and form a groove between them. A rib 5 of base 6 fits into the groove between ribs 3 and 4 to permit the base 6 and body 2 to be rotatable with respect to one another. The base 6, jutts out over the end of the body 2. The outside of base 6 can be knurled to make for better gripping and to allow it to be easily rotated with respect to the body 2. A grid is installed approximately in the axial center of cylindrical body 2.

A sodium containing container 8 and a water containing container 9, or, if applicable, a Raney nickel containing container 10 will be located between the grid 7 and the base 6 (FIGS. 2 and 3 respectively). These containers are fixed to both the base 6 and the grid 7 so that when base 6 is rotated the containers are twisted. By twisting the base, the containers break, bringing sodium into contact with the water, in the case of FIG. 2, or in the case of FIG. 3, enabling Raney nickel to contact the surrounding air. This allows an exothermic reaction to take place in both cases.

The space remaining in the cap between the grid and base 6 may be filled with a moderator 11. The moderator may be tobacco fiber and/or calcium carbonate and/or activated carbon and/or charcoal, or the like.

The tip of the cigarette 12 is forced into the cylindrical body 2 until it is flush with the grid 7.

FIGS. 4 to 6 show a solution much like that in FIGS. 1 to 3. Accordingly, the same numbers are used, but this time written as prime numbers.

The sole difference between the embodiments of FIGS. 1–3 and those of FIGS. 4–6 is that the later is activated axially and base 6′ slides axially along body 2′. In this manner containers 8′ and 9′, or container 10′ is compressed against the grid (7′) and break. In order to facilitate the axial movement of part 6′, rib 4 has been eliminated. Once the container(s) have been broken, the remainder of the operation of the self-lighter is identical to that described in the previous embodiment solution.

FIGS. 7 to 9 illustrate a third radially activated embodiment of the invention. In this particular case the cap (1″) is comprised solely of a cylindrical body 2″ having air holes (not shown) formed therein. This cap is solid, closed off on one end and made of a maleable material so that the body 2″ can be deformed radially and the container 8″, 9″ or the container 10″ broken.

The containers designed to carry the reactant elements may take on a variety of shapes and forms, apart from those already mentioned. Moreover, they can be manufactured in any non-toxic material desired, and equipped with break-off points according to the use in question. Hence, one container could even be located inside another.

With regard to the cap, it could also vary greatly in terms of shape and size, and can be made from any non-toxic, insulating and mechanically resistent material, such as polypropylene, polyethylene, aluminum coated material, waxed cardboard or any other like product.

The following is an overview of the new system proposed in this invention described through a series of examples. However, these are merely illustrative and may not be considered as restricting the scope of application of this invention.

EXAMPLE 1

In two different containers 50 mg. of sodium and 30 mg. of water have been placed. These containers are then introduced into a cap, which in turn is located on the tip of the cigarette. Ten milligrams of ethyl alcohol is used as a moderator.

After activating the cap, either by twisting it or by applying pressure, the containers break and the reactants come into contact. The cigarette lights up perfectly and the cap immediately detaches.

A slight odor results from vaporization of the alcohol and a faint sweet and alkaline taste can be observed, which are in no way toxic.

EXAMPLE 2

Example 1 was repeated, but this time using one container of 150 mg. Raney nickel along with a moderator to delay reaction.

When the container breaks and the Raney nickel begins to oxidize with the surrounding air, heat is generated and the cigarette lights automatically.

In the latter case, no smell, or taste will be observed.

After having adequately described the nature of this invention, as well as the practical aspects of its use, it should be clearly understood that the aforementioned points are subject to modification with regard to details, provided that the fundamental principles remain unchanged.

I claim:

1. A cigarette lighting cap, comprising:

a housing having an upper section and a lower section divided by a grid, said upper section adapted to receive the front end of a cigarette;

a container located in said lower section of said housing and containing a substance which reacts, upon direct contact with air, to produce a sufficient amount of heat to ignite said front end of said cigarette when a cigarette is located in said upper section of said housing; and means for breaking said container in response to a predetermined actuation by the user of said cap.

2. A cap according to claim 1, further including at least one adjuvant which acts as a moderator and stabilizes the reaction between said substance and air with respect to time and temperature.

3. A cap according to claim 1, wherein said predetermined actuation is the rotation of two parts of said housing with respect to one another, said container being firmly attached to both said parts.

4. A cap according to claim 1, wherein said predetermined actuation is the relative axial displacement between two parts of said housing.

5. A cap according to claim 1, wherein said predetermined actuation is the deformation of said housing so as to press said housing radially against said container.

6. A cap according to claim 1, wherein air holes are formed in said housing.

7. A cigarette lighting cap, comprising:

a housing having an upper section and a lower section divided by a grid, said upper section adapted to receive the front end of a cigarette;

first and second containers located in said lower section of said housing, said containers containing respective substances which react with each other when released from their respective said containers to produce a sufficient amount of heat to ignite said front end of a cigarette when a cigarette is located in said upper section of said housing; and means for breaking said containers in response to a predetermined actuation by the user of said cap.

8. A cap according to claim 7, further including at least one adjuvant which acts as a moderator and stabilizes the reaction between said substances with respect to time and temperature.

9. A cap according to claim 7, wherein said predetermined actuation is the rotation of two parts of said housing with respect to one another, each of said containers being firmly attached to both said parts.

10. A cap according to claim 7, wherein said predetermined actuation is the relative axial displacement between two parts of said housing.

11. A cap according to claim 7, wherein said predetermined actuation is the deformation of said housing so as to press said housing radially against said containers.

12. A cap according to claim 7, wherein said first container is located inside said second container.

13. A cap according to claim 7, wherein air holes are formed in said housing.

14. A system for self-lighting cigarettes, comprising:

(A) a cigarette; and (B) a cap attached to a front end of said cigarette, said cap including:

(1) a housing attached to one end of said cigarette, said housing having a hollow chamber formed therein;

(2) a container located in said chamber and containing a substance which reacts, upon direct contact with air, to produce a sufficient amount of heat to ignite said front end of said cigarette; and (3) means for breaking said container in response to a predetermined actuation by the user of said cap.

15. The system of claim 14, further including at least one adjuvant which acts as a moderator and stabilizes the reaction between said substance and air with respect to time and temperature.

16. The system of claim 14, further including air holes extending from said chamber to the exterior of said housing.

17. The system of claim 14, wherein said predetermined actuation is the rotation of two parts of said housing with respect to one another, said container being firmly attached to both said parts.

18. The system of claim 14, wherein said predetermined actuation is the relative axial displacement between two parts of said housing.

19. The system of claim 14, wherein said predetermined actuation is the deformation of said housing so as to press said housing radially against said container.

20. The system of claim 14, wherein said container is egg-shaped.

21. A system for self-lighting cigarettes, comprising:

(A) a cigarette; and (B) a cap coupled to a front end of said cigarette, said cap including:

(1) a housing coupled to one end of said cigarette and having a hollow chamber formed therein;

(2) first and second containers located in said chamber, said containers containing respective substances which react with each other when released from their respective said containers to produce a sufficient amount of heat to ignite said front end of said cigarette; and (3) means for breaking said containers in response to a predetermined actuation by the user of said cap.

22. The system of claim 21, further including at least one adjuvant which acts as a moderator and stabilizes the reaction between said substances with respect to time and temperature.

23. The system of claim 21, further including air holes extending from said chamber to the exterior of said housing.

24. The system of claim 21, wherein said predetermined actuation is the rotation of two parts of said housing with respect to one another, said containers being firmly attached to both said parts.

25. The system of claim 21, wherein said predetermined actuation is the relative axial displacement between two parts of said housing.

26. The system of claim 21, wherein said predetermined actuation is the deformation of said housing so as to press said housing radially against said containers.

27. The system of claim 21, wherein said containers are egg-shaped.

28. The system of claim 21, wherein said first container is located within said second container.

* * * * *